United States Patent [19]

Fujita

[11] Patent Number: 5,018,322

[45] **Date of Patent: * May 28, 1991**

[54] ELECTRICALLY-OPERATED FOLDING STAGE SYSTEM

[76] Inventor: Kazuo Fujita, No. 1, Hagiyamadai 1-Chome, Seto-shi, Aichi-ken, Japan

[ * ] Notice: The portion of the term of this patent subsequent to Oct. 10, 2006 has been disclaimed.

[21] Appl. No.: 475,867

[22] Filed: Feb. 6, 1990

[30] Foreign Application Priority Data

Apr. 15, 1989 [JP] Japan ..... 1-96187

[51] Int. Cl.[5] ..... E04H 3/26

[52] U.S. Cl. ..... 52/7; 52/64; 182/223

[58] Field of Search ..... 52/7, 10, 64; 182/141, 182/223; 108/6-10; 272/9, 12

[56] References Cited

U.S. PATENT DOCUMENTS

| | | | |
|---|---|---|---|
| 2,978,754 | 4/1961 | Wilson | 52/7 X |
| 3,086,256 | 4/1963 | Schieber, Jr. | 52/71 X |
| 3,091,816 | 6/1963 | Wetzel | 52/71 X |
| 4,412,403 | 11/1983 | LeFranc et al. | 52/79.5 X |
| 4,872,295 | 10/1989 | Fujita | 52/7 |
| 4,885,878 | 12/1989 | Wuu | 52/7 X |

FOREIGN PATENT DOCUMENTS

| | | | |
|---|---|---|---|
| 185078 | 3/1956 | Austria | 50/64 |
| 753000 | 2/1967 | Canada | 52/7 |

*Primary Examiner*—David A. Scherbel
*Assistant Examiner*—Lan Mai
*Attorney, Agent, or Firm*—Fred Philpitt

[57] ABSTRACT

The fundamental construction of an electrically-operated folding stage system which embodies the invention in the most preferred form comprises (A) a stage body with (i) a platform, (ii) plural rows of legs with upper ends connected to a bottom of the platform, each row of the legs including a foremost leg and other legs having greater lengths than the foremost leg, and (iii) means for pivotally connecting the upper end of the foremost leg to the bottom of the platform, (B) wheels connected to bottoms of the foremost legs to facilitate movements of the stage body on a floor, (C) geared motors having output shafts, fixed to the bottom of the platform, and each capable of being rotated in either of opposed directions to move the stage body between a horizontal position on the floor and a vertical position immediately adjacent to a wall, (D) swing arms each having one end fixed to the output shaft of one of the geared motors, and (E) support means each provided in conjunction with one of the swing arms and located on a given position predetermined in relation to a lower portion of the wall for pivotally supporting an opposed end of the swing arm. The swing arm may comprise a pair of integrally formed tubes and a pair of rods slidably disposed in the respective tubes.

8 Claims, 6 Drawing Sheets

ELECTRICALLY-OPERATED FOLDING STAGE SYSTEM

FIELD OF THE INVENTION

This invention relates to relatively low types of electrically-operated folding stage systems.

BACKGROUND OF THE INVENTION

A typical folding stage system of the prior art is proposed in Japanese Application for Registration of Utility Model No. 52-82315 (published under No. 60-25482). The prior folding stage system has a guide post to be fixed to a wall or the like, and a balancer mechanism supporting the rear portion of the stage body for vertical movement The prior folding stage system also has, on its front portion, wheels to enable the stage body to be moved on a floor. The stage body of the system can be "folded" or stored from a horizontal position on the floor to a vertical position adjacent to the post. Legs are pivotally connected to the bottom of a platform so that the legs make right angles with the platform when supporting the platform on the floor, but change their angles to the platform as the legs are raised away from the floor when the stage body is moved to the vertical position, and become parallel to the platform when the platform is moved to a vertical position.

The inventor hereof proposed a folding stage system similar to the foregoing one in Japanese Application for Registration of Utility Model No. 59-100829 (published under No. 61-16200).

However, with the help of the balancer mechanism, either of the prior folding stage systems must be manually folded or unfolded. Also, the presence of the guide post and the balancer mechanism provided therein relatively complicates the construction of the whole system.

SUMMARY OF THE INVENTION

Accordingly, it is an object of the invention to provide a folding stage system which is operated electrically.

Another object of the invention is to provide a folding stage system having no guide post and, hence, having a relatively simple construction.

The fundamental construction of an electrically-operated folding stage system which embodies the invention in the most preferred form comprises (A) a stage body with (i) a platform, (ii) plural rows of legs with upper ends connected to a bottom of the platform, each row of the legs including a foremost leg and other legs having greater lengths than the foremost leg, and (iii) means for pivotally connecting the upper end of the foremost leg to the bottom of the platform, (B) wheels connected to bottoms of the foremost legs to facilitate movements of the stage body on a floor, (C) geared motors having output shafts, fixed to the bottom of the platform, and each capable of being rotated in either of opposed directions to move the stage body between a horizontal position on the floor and a vertical position immediately adjacent to a wall, (D) swing arms each having one end fixed to the output shaft of one of the geared motors, and (E) support means each provided in conjunction with one of the swing arms and located on a given position predetermined in relation to a lower portion of the wall for pivotally supporting an opposed end of the swing arm. The swing arm may comprise a pair of integrally formed tubes and a pair of rods slidably disposed in the respective tubes.

BRIEF DESCRIPTION OF THE DRAWING

In FIGS. 7 and 8 a lower portion of the stage system is viewed from one side thereof and from the front thereof, respectively.

DETAILED DESCRIPTION OF PREFERRED EMBODIMENTS First Embodiment

Figure 1:
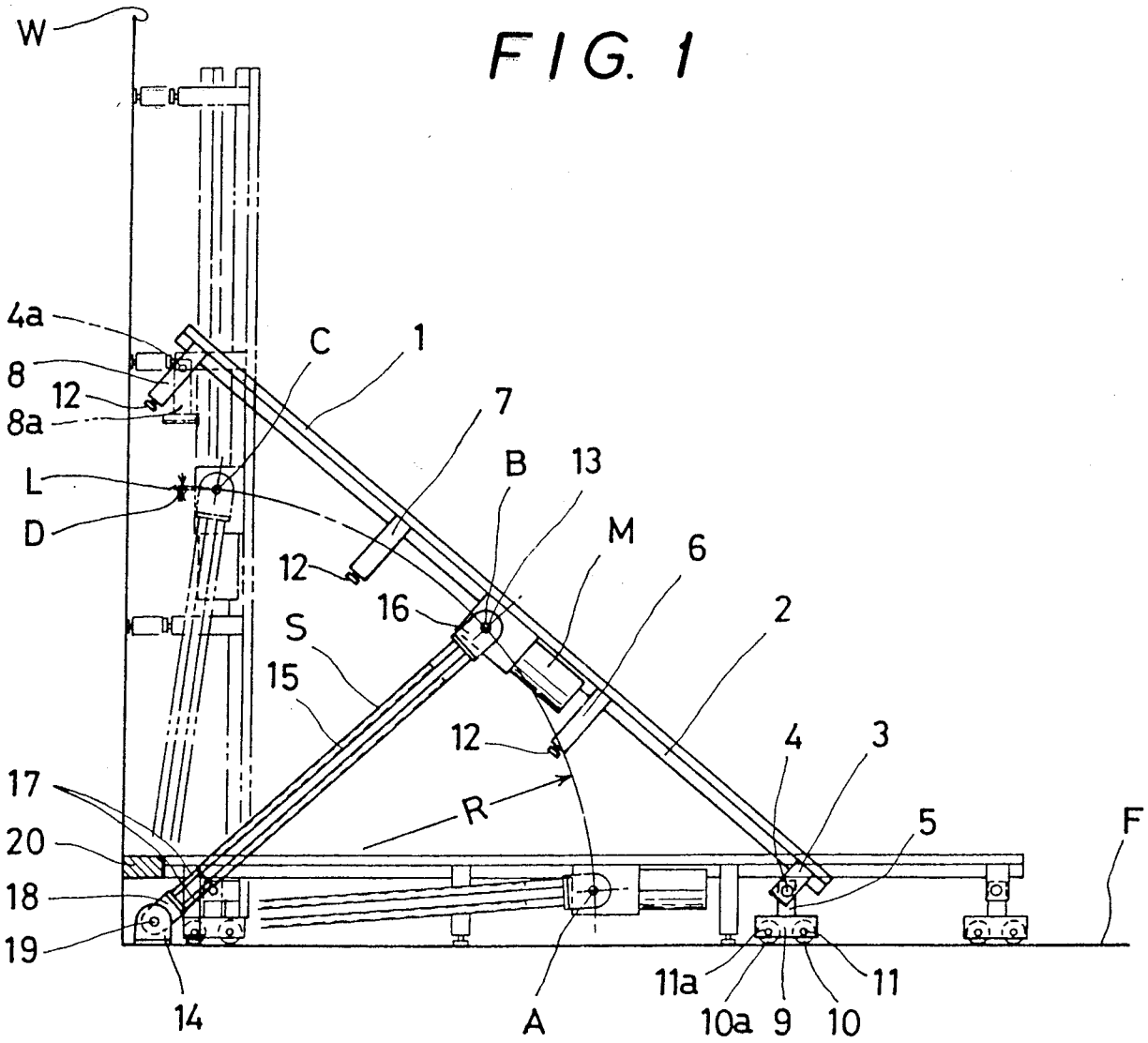
FIG. 1 is a side view of an electrically-operated folding stage system which embodies the invention in one preferred form.
Figure 2:
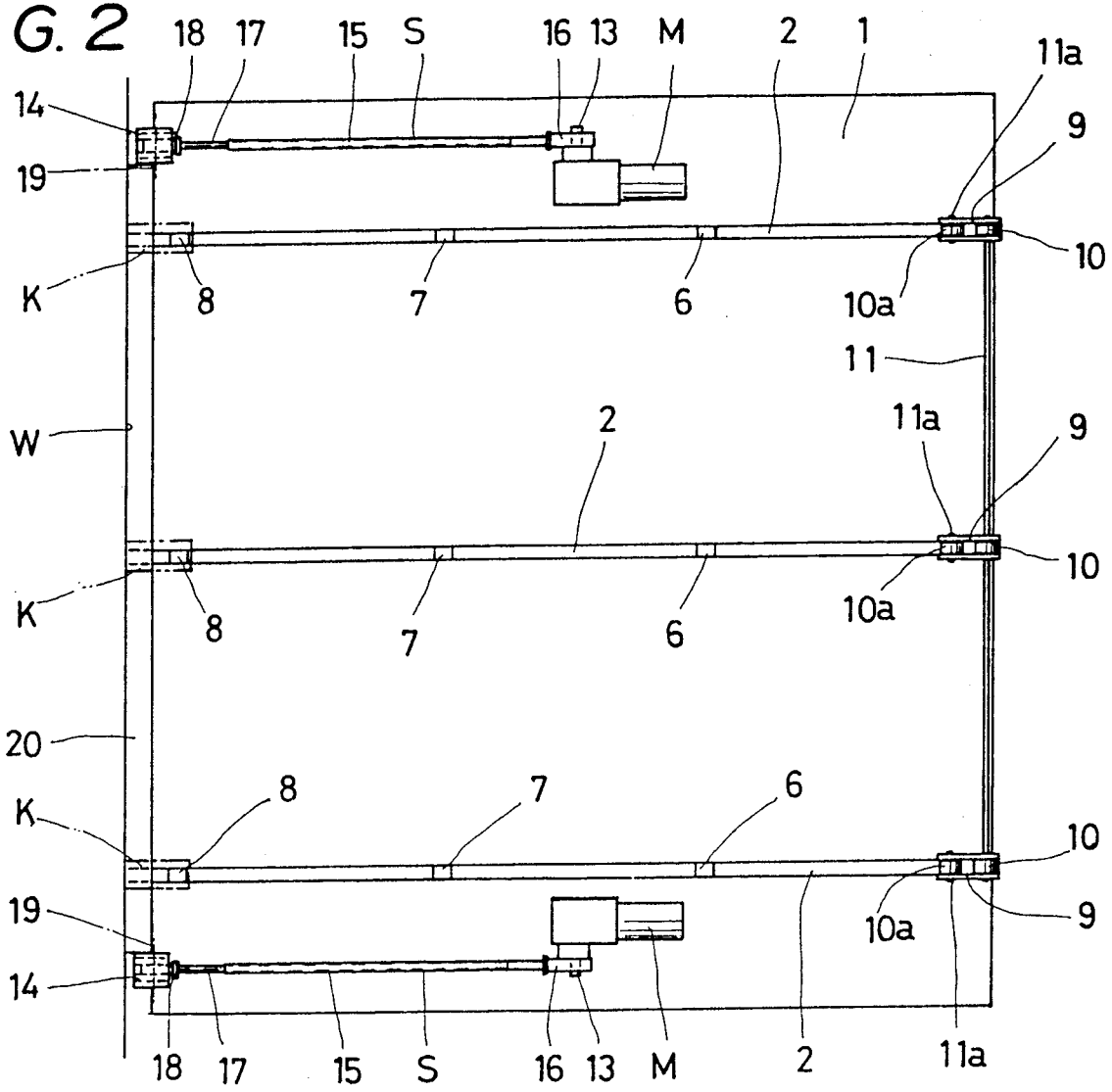
FIG. 2 is a bottom view of the system of FIG. 1.

A folding stage system which embodies the invention in one preferred form is illustrated in FIGS. 1 and 2. The folding stage system includes a platform 1 which provides a stage when the stage system is in the state of being unfolded to a horizontal position. Plural parallel beams 2 are fixed to the bottom of the platform 1. In the illustrated embodiment the beams 2 are three in number. The beams 2 extend from the front side to the rear side of the platform. Support members 3 are fixed to the front portion of the bottom of the platform, and are associated with the respective beams 2. Each support member 3 has an upper recess through which the associated support member 3 extends. Short legs 5 are pivotally connected by pins 4 to the lower ends of the support members 3, respectively. Legs 6, 7 and 8 longer than the foremost legs 5 are arranged along the beam 2. The legs 6, 7 and 8 have upper ends fixed to the bottom of the platform, and each have an upper recess through which the associated beam 2 extends. The legs 6, 7 and 8 are at right angles to the platform.

An enclosure 9 is fixed to the bottom of each foremost leg 5. A pair of lined-up wheels 10 and 10*a* are provided in the enclosure 11. The wheel 10*a* is supported on a short axle 11*a* extending laterally through the enclosure 9. The wheel 10 is supported on a long axle 11 which extends along a line connecting the bottoms of the foremost legs 5 and on which the other wheels 10 associated with the other foremost legs 5 are also supported. The greater part of each wheel is covered with the enclosure 11. The wheels 10 and 10*a* facilitate the movement of the stage body on a floor F. The "stage body" herein collectively means the platform 1 and the foregoing construction connected to the bottom of the platform.

Auxiliary legs 12 are fixed to the bottoms of all the legs other than the foremost legs 5. The auxiliary legs 12 have such heights that, when the auxiliary legs 12 are on the floor, the tops of the associated legs are on a level with the tops of the support members 3. Thus, when the stage system is in the state of being unfolded, the platform is in a horizontal position on the floor.

A pair of opposed geared motors M may be fixed on the bottom of the platform 1 with the foregoing structure connected to the bottom of the platform between. More than two geared motors may be provided if the dimension between the sides of the platform is relatively long. Each geared motor M may be rotated in either of opposed directions. Each geared motor has an outwardly projecting output shaft 13. The output shaft 13 has a torque limiter (not shown) therein. The output shaft should preferably be located rearwardly of the straight line connecting one side of the stage body, the center of gravity thereof and the other side thereof This arrangement facilitates the raising of the rearward end portion (the left-hand end portion) of the stage body by swing arms (which will be described later). As illustrated, swing arm supports 14 may be fixed on the floor in positions which are in close proximity to a wall W. If desired, however, the swing arm supports 14 may be fixed to a corner where the floor F and the wall meet or may be fixed to portions of the wall W which are in lower levels than the platform 1 when the platform 1 is in a horizontal position.

The letter S designates a swing arm. The swing arm S includes a pair of integrally formed tubes 15 and a pair of rods 17 slidably disposed in the respective tubes 15. The tubes 15 are fixed to the output shaft 13 of the geared motor M at 16. The lower ends of the rods 17 are connected together by means of connecting means 18. The connecting means 18 is pivotally connected to the swing arm support 14 by a pin 19.

If desired, the integrally formed tubes 15 may be replaced with a cylinder (not shown).

A horizontal ledge 20 is fixed to the wall W, and is flush with the platform 1 when the platform 1 is in the horizontal position on the floor. The ledge 20 serves to fill the gap between the wall W and the platform 1 when the platform 1 is in the horizontal position on the floor.

Folding of the Stage System

When the stage system is to be folded from its horizontal position on the floor of a gymnasium, a public hall or the like to a vertical position adjacent to the wall W, the motors M are simultaneously operated to rotate their output shafts 13 clockwise (in FIG. 1) at a very low speed, e.g., at a reduction ratio of 1:24,000. Thus each swing arm S gradually raises the rear portion of the stage body as the swing arm S makes an arcing motion toward the wall W. Concomitantly the wheels 10 and 10*a* move toward the wall W. Also, the foremost legs 5 change their angles to the platform from the right angles to acute angles.

When the stage body is in the horizontal position on the floor, the output shaft 13 of each geared motor M is in a position indicated by the letter A. As the rear portion of the stage body is raised, the output shaft 13 makes an arcing motion as indicated by a curved line of FIG. 1. When the output shaft 13 passes a position B, the stage body is still in the process of moving to a vertical position.

When the output shaft 13 has reached a position C, the stage body is in a first vertical position as shown in phantom (in FIG. 1) where the auxiliary legs 12 are a little distant from the wall W.

While the output shaft 13 moves from the position A to the position C, the rods 17 do not change their positions relative to the tubes 15, i.e., do not come more deeply into the tubes 15 nor project therefrom by greater amounts. Thus, while the output shaft 13 moves from the position A to the position C, the distance between the pivotal pin 19 and the output shaft 13 does not vary.

The motors M are still being operated. Thus, the swing arm S causes the stage body to move further to the left (in FIG. 1). The stage body moves without changing its vertical posture. When the auxiliary legs 12 have come into contact with the wall W, the motors M are stopped. The stage body now is in a second vertical position adjacent to the wall W. The output shaft 13 is now in a position D which is on the same level as the position C. While the stage body is thus moved from the first vertical position to the second vertical position, the rods 17 retract into the tubes 15 by an amount equal to the radius R from the center of the pivotal pin 19 to the center of the output shaft 13 when the output shaft 13 was making the arcing motion from the positions A to C minus the distance from the center of the pivotal pin 19 to the center of the output shaft 13 when the stage body is in the second vertical position Thus, while the stage body is moved from the first vertical position to the second vertical position, the distance between the pivotal pin 19 and the output shaft 13 is reduced by the foregoing amount.

While the stage system is thus folded, or stored, from the horizontal position to the second vertical position, the output shaft 16 is rotated for substantially 180 degrees.

Unfolding of the Stage System

When the stage system is be unfolded from its second vertical position to a horizontal position, the motors M are simultaneously operated to rotate their output shafts 13 counterclockwise (in FIG. 1) at a very low speed, e.g., at a reduction ratio of 1:24,000. Thus the swing arm S starts to arc in a counterclockwise direction to cause the wheels 10 and 10*a* to move forward away from the wall W. The stage body comes to the foregoing first vertical position without changing its vertical posture. While the stage body comes to the first vertical position, the rods 20 so slide relative to the tubes 18 that the distance between the pivotal pin 19 and the output shaft 13 increases by the foregoing amount. After the stage body has reached the first vertical position, the upper end portion thereof starts to be lowered. The stage body is thus unfolded to the horizontal position on the floor. While the stage body is moved from the first vertical position to the horizontal position, the distance between the pivotal pin 19 and the output shaft 13 does not vary.

While the stage system is thus unfolded from the second vertical position to the horizontal position, the output shaft 13 is rotated for substantially 180 degrees.

Second Embodiment

Figure 3:
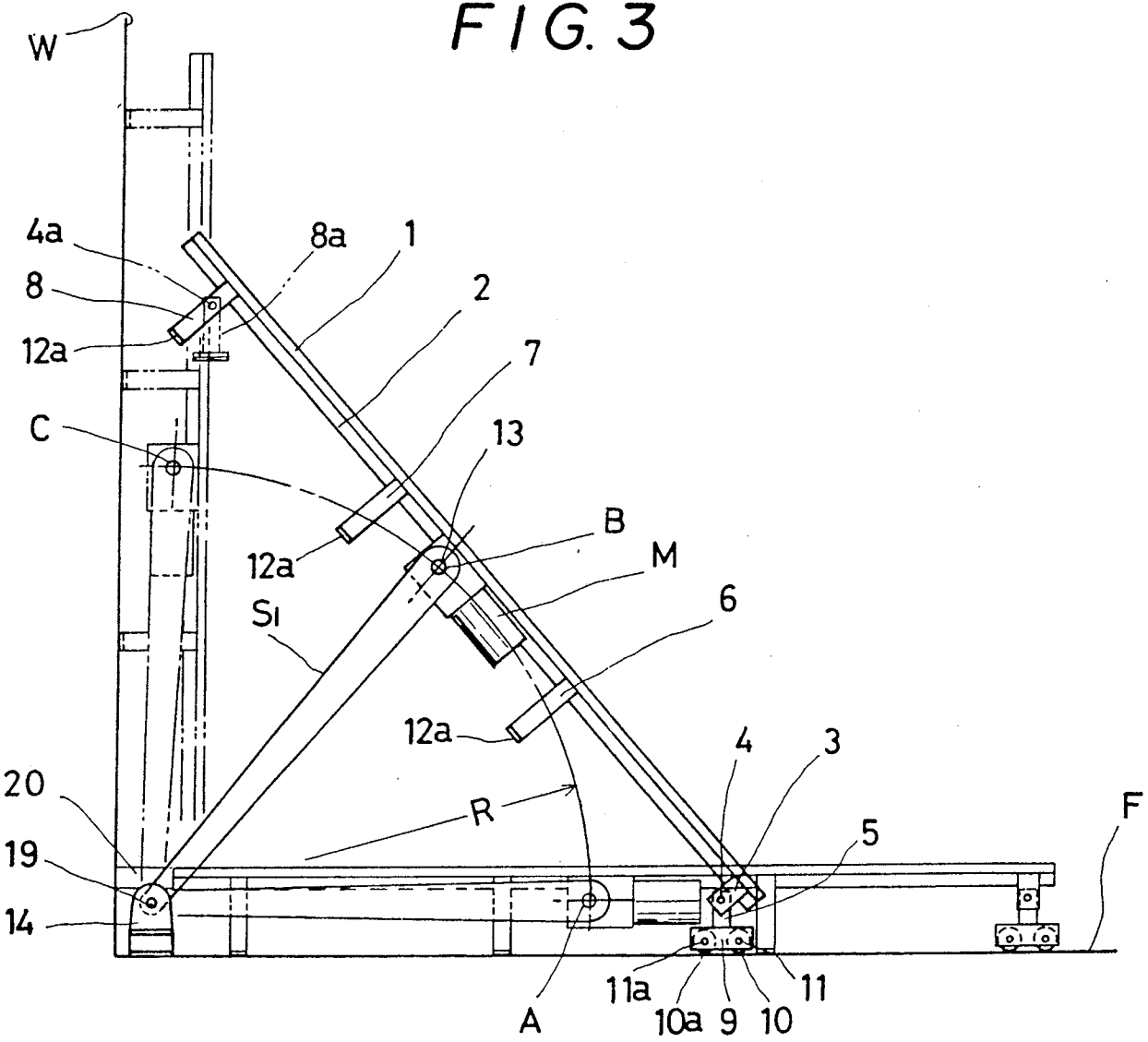
FIG. 3 is a side view of an electrically-operated folding stage system which embodies the invention in another preferred form.

FIG. 3 depicts a stage system which embodies the invention in another preferred form. The stage system of FIG. 3 differs from the stage system of FIG. 1 in that an inextensible swing arm $S_1$ is used instead of the extensible swing arm S. Unlike the swing arm S, the swing arm $S_1$ comprises a single continuous member. The stage system of FIG. 3 also differs from the stage system of FIG. 1 in that pads 12*a* of hard rubber instead of the auxiliary legs 12 of FIG. 1 are fixed to the bottoms of all the legs other than the foremost ones. In the other respects the stage system of FIG. 3 has the same construction as that of FIG. 1. Parts equivalent to those of the stage system of FIG. 1 are indicated by the same numerals.

Third Embodiment

Figure 4:
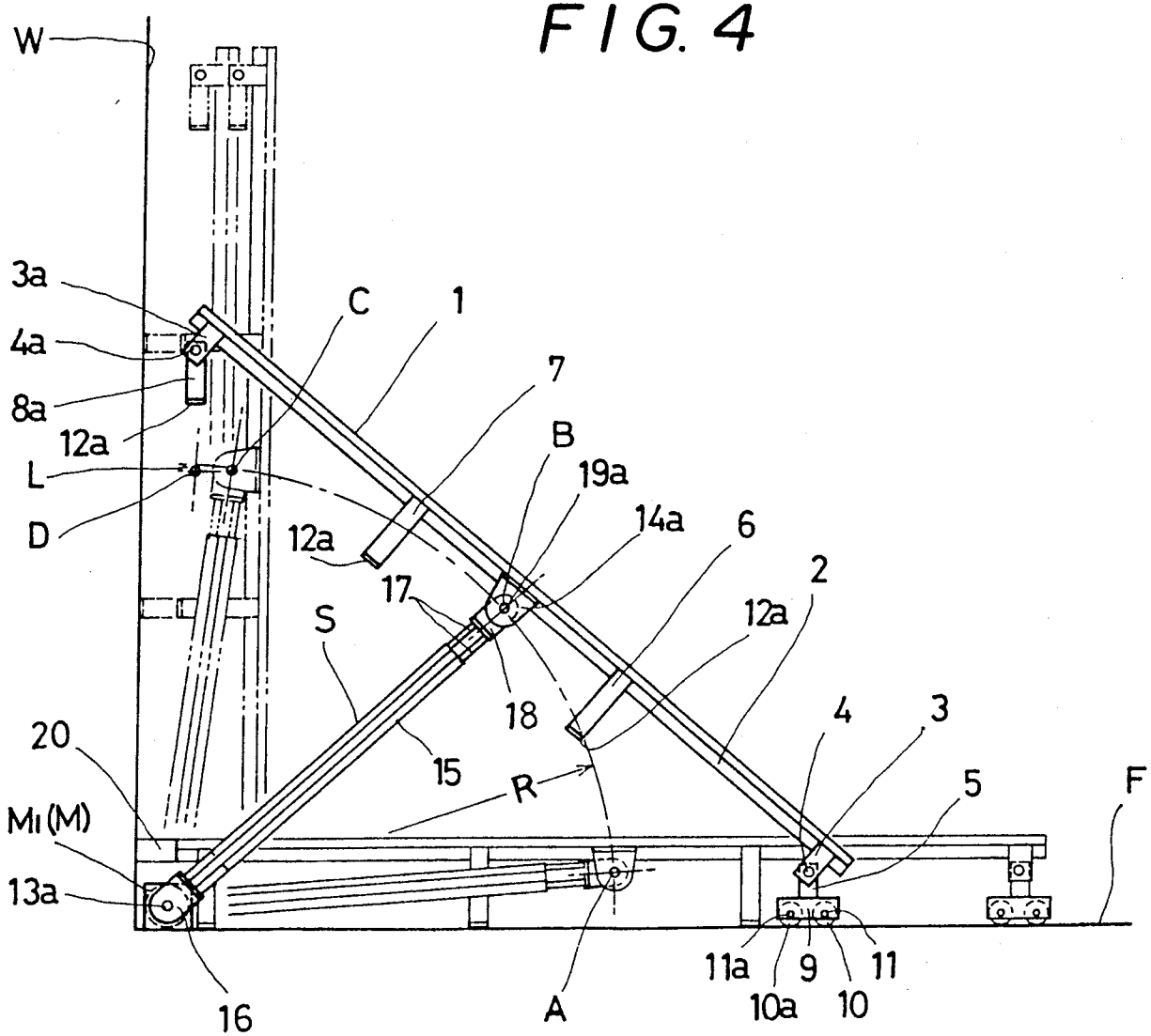
FIG. 4 is a side view of an electrically-operated folding stage system which embodies the invention in still another preferred form.

FIG. 4 depicts a stage system which embodies the invention in still another preferred form. The stage system of FIG. 4 differs from that of FIG. 1 in that the former has an operating mechanism which is arranged reversely to the latter. That is, with the stage system of FIG. 4, a pair of integrally formed tubes 15 are fixed at 16 to an output shaft 13*a* of a geared motor M which is secured to the floor in a position which is in close proximity to the wall W. And a pair of rods 17 slidably disposed in the respective tubes 15 are pivotally connected at 18 by a pin 19*a* to a support 14*a* fixed to the bottom of the platform. In the other respects the stage system of FIG. 4 has the same construction as that of FIG. 1. Parts equivalent to those of the stage system of FIG. 1 are indicated by the same numerals.

The support 14*a* should preferably be located such that the pin 19*a* connecting the rods 17 thereto is in a position which is further from the front of the stage body than the straight line connecting one side of the stage body, the center of gravity thereof and the opposed side thereof. Such an arrangement facilitates the raising of the rearward end portion (the lefthand end portion) of the stage body by the swing arm S.

If desired, the geared motors M may be fixed to a corner where the floor F and the wall meet or may be fixed to portions of the wall W which are in lower levels than the platform 1 when the platform 1 is in a horizontal position.

Also, if desired, the geared motor of FIG. 4 may be replaced with other means for electrically operating the stage body.

It is also possible to modify the stage system of FIG. 4 into a form similar to that of FIG. 3. That is, the swing arm S of FIG. 4 may be replaced with a single continuous member which is not extensible.

Figure 5A:
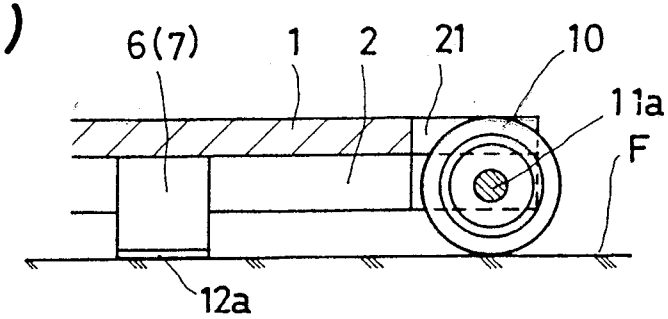
FIGS. 5(*a*), 5(*b*) and 5(*c*) depict wheels and related constructions which may be used to construct folding stage systems of small heights.
Figure 5B:
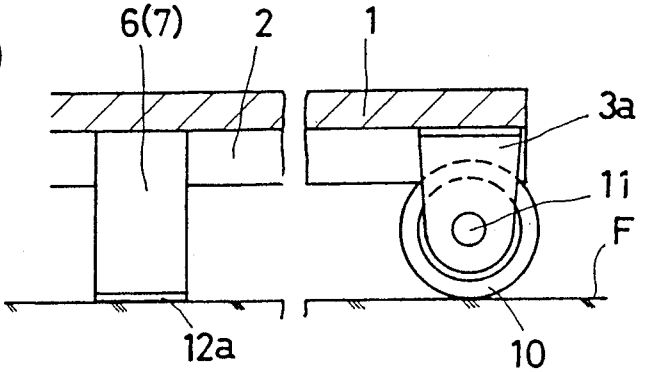
Figure 5C:
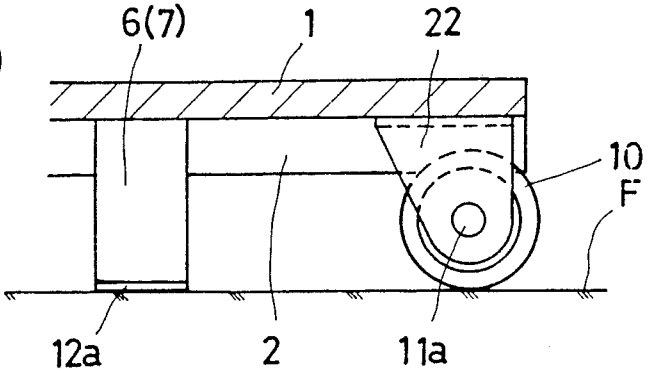

Variation of Means for Facilitating the Movement of the Stage Body on the Floor If desired, a single wheel 10 of FIG. 5(*a*) instead of the two wheels 10 and 10*a* of FIG. 1 may be used to construct a stage system of the invention. For this embodiment, the front end of a platform 1 is recessed to receive the wheel 10. The wheel 10 is supported on an axle 11*a*. No leg is used in conjunction with the front end of the platform. Also for this embodiment, legs 6, 7 and 8 of very small heights are used in harmony with the height of the wheel 10. Thus, such a construction may be used to construct a stage system of a much smaller height than the stage system of FIG. 1.

Also, if desired, a single wheel 10 of FIG. 5(*b*) instead of the two wheels 10 and 10*a* of FIG. 1 may be used to construct a stage system of the invention. In this embodiment the wheel 10 is supported on an axle 11 extending through the wheel 10 and a foremost leg 3*a* which is fixed to the bottom of the platform at its top. Legs 6, 7 and 8 of relatively small heights are used in harmony with the overall height of the wheel 10 and foremost leg 3*a*. Thus, such a construction may be used to construct a stage system of a smaller height than the stage system of FIG. 1, but of a greater height than the stage system having the construction of FIG. 5(*a*).

Moreover, if desired, a wheel 10 of FIG. 5(*c*) instead of the two wheels 10 and 10*a* may be used to construct a stage system of the invention. In this embodiment the wheel 10 is supported on an axle 11*a* extending through the wheel 10 and a wheel support 22 fixed to the bottom of the platform No leg is used in conjunction with the front end of the platform. Legs 6, 7 and 8 of relatively small heights are used in harmony with the overall height of the wheel 10 and wheel support 22. Thus, such a construction also may be used to construct a stage system of a smaller height than the stage system of FIG. 1, but of a greater height than the stage system having the construction of FIG. 5(*a*).

Variation of Legs

Figure 6:
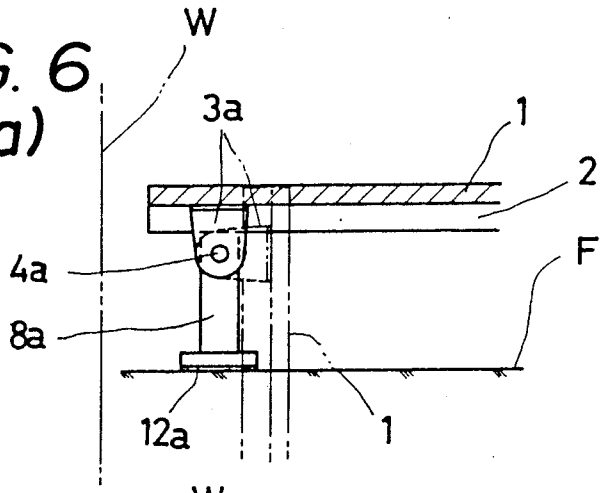
FIGS. 6(*a*) and 6(*b*) show variations of rearmost legs.
Figure 6:
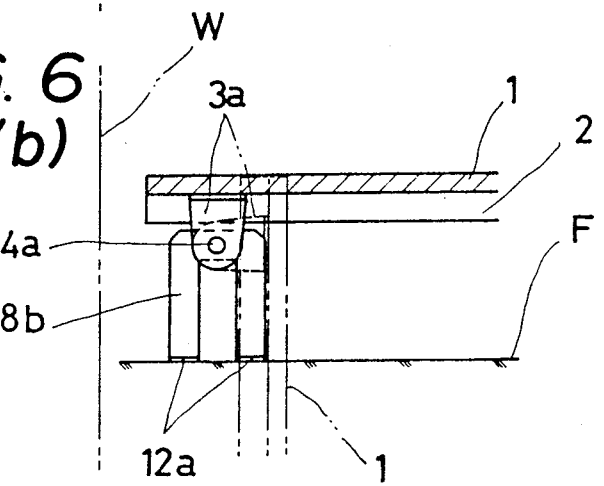

If desired, the rearmost leg 8 may be replaced with a rearmost leg 8*a* of FIG. 6(*a*) or a rearmost leg 8*b* of FIG. 6(*b*).

In the construction of FIG. 6(*a*) the rearmost leg 8*a* is pivotally connected by a pin 4*a* to a support member 3*a* fixed to the bottom of the platform. The support member 3*a* has a flat bottom portion. Such a rearmost leg 8*a* is also shown in phantom in FIGS. 1 and 3 and by a solid line in FIG. 4.

In the construction of FIG. 6(b) the rearmost leg 8*b* is also pivotally connected by a pin 4*a* to a support member 3*a* fixed to the bottom of the platform. The rearmost leg 8*b* is a gate-shaped leg.

If such a rearmost leg 8*a* or 8*b* is used, the rearmost leg always maintains an upright position since it turns on the pin 4*a* as the stage system is folded or unfolded.

Variation of Wheels and Addition of Storing Means

Figure 8:
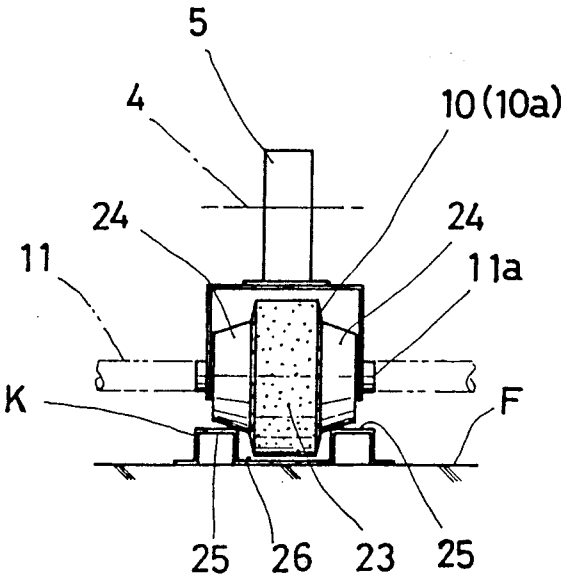
Figure 7:
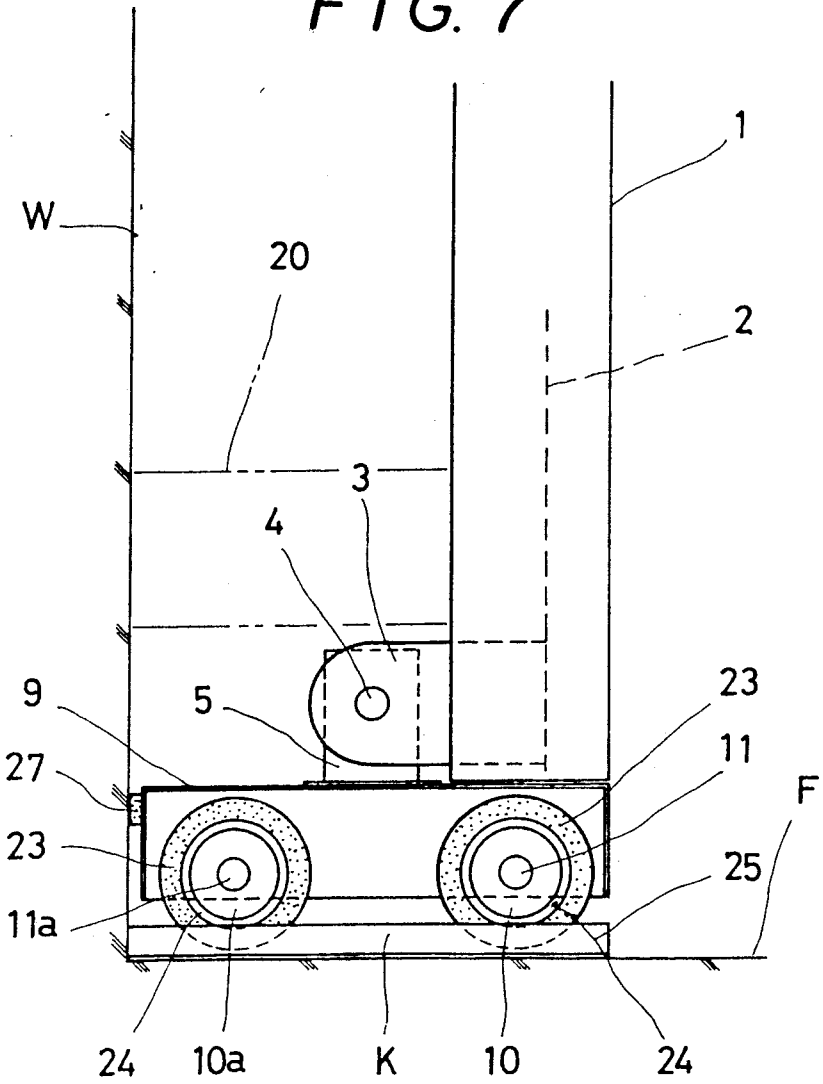
FIGS. 7 an 8 depict wheels which may be used instead of wheels of FIGS. 1 and 2, together with a storing means.

Wheels 10 and 10*a* of FIGS. 7 and 8 may be used instead of the wheels 10 and 10*a* of FIG. 1. In FIGS. 7 and 8 a lower portion of the stage system is viewed from one side thereof and from the front thereof, respectively. Each wheel of FIGS. 7 and 8 comprises a central circular portion 23 of hard rubber and a pair of outer beveled circular portions 24 of metal fixed to the central circular portion 23. In addition, in conjunction with each pair of the wheels of FIGS. 7 and 8 a short storing means K (of FIGS. 7 and 8) may be provided on a position on the floor F which adjoins the wall W. The storing means K comprises a pair of rails 25 and a flat bottom portion 26 located between the rails 25. When the stage system is stored to the previously second vertical position, the central portion 23 ride on the bottom portion 26 of the storing means K while the outer portions 24 roll on the rails 25.

A shock absorbing means 27 may be fixed to the rear side of the wheel cover 9.

The construction of FIGS. 7 and 8 allows the stage system to be stored more safely in the vertical position.

FIG. 2 shows the positions where the storing means K are to be located.

What is claimed is:

1. An electrically-operated folding stage system comprising (a) a stage body with (i) a platform and (ii) plural rows of legs with upper ends connected to a bottom of the platform, (b) plural wheel means each associated with one of the rows of the legs and provided in conjunction with a front end portion of the platform to facilitate movements of the stage body on a floor, (c) geared motors fixed to the bottom of the platform and each capable of being rotated in either of opposed directions to move the stage body between a horizontal position on the floor and a vertical position immediately adjacent to a wall, each of the geared motors having an output shaft, (d) swing arms each having one end fixed to the output shaft of one of the geared motors, and (e) support means each provided in conjunction with one of the swing arms and located on a given position predetermined in relation to a lower portion of the wall for pivotally supporting an opposed end of the swing arm, said given position being selected from among a corner at which the floor and the wall meet, a position on the floor which is in close proximity to the wall, and a position on the wall which is on a lower level than the platform when the platform is in a horizontal position on the floor.

2. A system in accordance with claim 1 wherein each row of the legs includes a foremost leg fixed to the front end portion of the platform and other legs having greater lengths than the foremost leg, and each of the wheel means comprises a single wheel connected to the foremost leg.

3. A system in accordance with claim 1 wherein each row of the legs includes a foremost leg pivotally connected to the front end portion of the platform and other legs having greater lengths than the foremost leg, and each of the wheel means comprises a pair of front and rear wheels connected to a bottom of the foremost leg.

4. A system in accordance with claim 3 wherein each of the front and rear wheels comprises a central circular portion of rubber and a pair of outer beveled circular portions of metal fixed to opposed sides of the central circular portion, and plural storing means are provided in positions on the floor which adjoin the wall and are each adapted to support one of the wheel means when the stage body is in the vertical position.

5. A system in accordance with claim 1 wherein each row of the legs includes a foremost leg fixed to a portion of the bottom of the platform which is a certain distance from the front end portion of the platform and other legs having the same heights as the foremost leg, and each of the wheel means comprises a single wheel with an upper portion received in a recess which is provided in the front end portion of the platform.

6. A system in accordance with claim 1 wherein the swing arm comprises a pair of integrally formed tubs and a pair of rods slidably disposed in the respective tubes.

7. A system in accordance with claim 1 further including means for pivotally connecting the upper end of a rearmost leg of each row of the legs to the bottom of the platform.

8. A system in accordance with claim 1 wherein said one end of the swing arm is fixed to the output shaft at a position which is further from a front of the stage body than a straight line connecting one side of the stage body, a center of gravity thereof and an opposed side thereof.

* * * * *